United States Patent [19]

George

[11] 4,283,811

[45] Aug. 18, 1981

[54] IMPROVED KNUCKLE HINGE

[76] Inventor: Peter J. George, 8 Myrtle Grove, Altona, 3018, Victoria, Australia

[21] Appl. No.: 930,714

[22] Filed: Aug. 3, 1978

[51] Int. Cl.[3] ..... E05D 15/00

[52] U.S. Cl. ..... 16/128 R; 29/11

[58] Field of Search ..... 16/128 R, 138, 161, 16/168, 169, DIG. 27, DIG. 29; D8/323, 327, 328; 29/11

[56] References Cited

U.S. PATENT DOCUMENTS

| | | | |
|---|---|---|---|
| 1,035,661 | 8/1912 | Toms et al. | 29/11 |
| 1,094,010 | 4/1914 | Parsons | 29/11 X |
| 1,649,586 | 11/1927 | Habart | 29/11 |
| 2,164,047 | 6/1939 | Baumann | 16/161 |
| 2,179,931 | 11/1939 | Harris | 16/161 |
| 3,006,039 | 10/1961 | Brydolf | 16/128 R X |
| 3,212,125 | 10/1965 | Hussell | 16/128 R X |
| 3,686,709 | 8/1972 | Tuvert | 16/128 R X |
| 3,911,528 | 10/1975 | Rojic, Sr. | 16/128 R |
| 3,949,445 | 4/1976 | Stevens | 16/128 R |

FOREIGN PATENT DOCUMENTS

| | | |
|---|---|---|
| 301589 | 11/1917 | Fed. Rep. of Germany . |
| 939913 | 3/1956 | Fed. Rep. of Germany . |
| 1580417 | 9/1969 | France . |

*Primary Examiner*—C. J. Husar
*Assistant Examiner*—Moshe I. Cohen
*Attorney, Agent, or Firm*—Andrus, Sceales, Starke & Sawall

[57] ABSTRACT

The present invention provides a hinge comprising leaves and a knuckle, the knuckle comprising tabs extending from the leaves and supporting hinging pivot means and at least one of the tabs of one leaf supporting at least one of the tabs of another leaf and further including strengthening webs extending from the respective tabs to the respective leaf and located on one side only, with respect to the hinging pivot axis, of each respective tab.

The present invention also provides a method of manufacturing a hinge comprising stamping a strip of metal to form a hinge leaf having projections extending from a side thereof, bending one part of each of said projections to form a tab lying generally perpendicular to the plane of the leaf and such that the remaining part of each of said projections lies on one side only of the respective tab and extends as a strengthening web between the tab and the leaf.

5 Claims, 26 Drawing Figures

IMPROVED KNUCKLE HINGE

FIELD OF THE INVENTION

The present invention relates to a hinge and to a method of making a hinge.

SUMMARY OF THE INVENTION

The present invention provides a hinge comprising leaves and a knuckle, the knuckle comprising tabs extending from the leaves and supporting hinging pivot means and at least one of the tabs of one leaf supporting at least one of the tabs of another leaf and further including strengthening webs extending from the respective tabs to the respective leaf and located on one side only, with respect to the hinging pivot axis, of each respective tab.

PREFERRED ASPECTS OF THE INVENTION

Each said web is preferably a triangular gusset.

Preferably each of said tabs is generally perpendicular to said hinging pivot axis. However, for selfclosing or -opening hinges or for rising hinges such as hinges for clearing carpet, the construction may be otherwise.

Preferably, each said web lies generally in the same plane as the leaf although for certain hinges this will not be so.

Hinges in accordance with this invention may be made in any convenient way. Among those ways may be mentioned extrusion, casting, moulding, fabrication, welding, forging or stamping. In one preferred aspect the hinges are made by moulding in synthetic plastics material.

In a particularly preferred aspect this invention provides a method of manufacturing a hinge comprising: stamping a strip of metal to form a hinge leaf having projections extending from a side thereof, bending one part of each of said projections to form a tab lying generally perpendicular to the plane of the leaf and such that the remaining part of each of said projections lies on one side only of the respective tab and extends as a strengthening web between the tab and the leaf.

The method may include the step of forming a hole for pivot means in said one part.

Preferably, said hole and the respective web are substantially tangential to one another.

The method preferably includes the step of forming two such leaves with such projections in one stamping operation from a single sheet metal and wherein the metal is stamped such that said projections are formed in the respective leaves adjacent to the other respective leaf.

DETAILED DESCRIPTION

Figure 2:
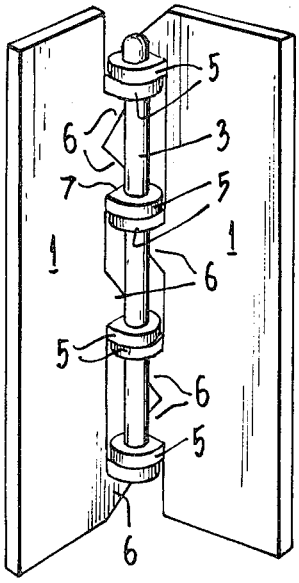
FIG. 2 is a perspective view of one hinge in accordance with this invention.
Figure 3:
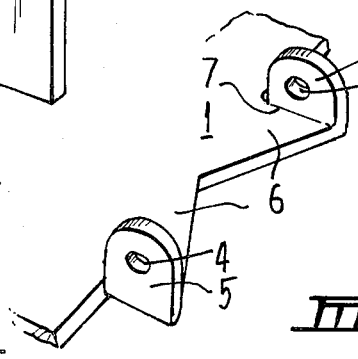
FIG. 3 is a perspective view of part of the hinge of FIG. 2, FIGS. 4, 5 and 6 are respectively plan, end and side view of another hinge in accordance with this invention.

Reference will firstly be made to FIGS. 2 and 3 which show a hinge comprised of leaves 1 and a knuckle comprised of a pivot pin 3 which passes through holes 4 in tabs 5 carried by each of the leaves. The tabs 5 provide bearing surfaces for one another and for the pin 3 and lie approximately at right angles to the plane of the leaves.

Each tab 5 is strengthened by means of a web 6 extending from the respective leaf to the respective tab.

Note that the holes 4 are preferably, but not essentially, close to, even tangential to, the angle indicated by the line 7.

Figure 4:
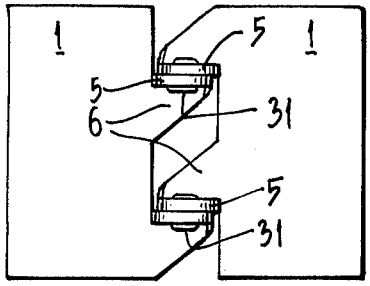
Figure 5:
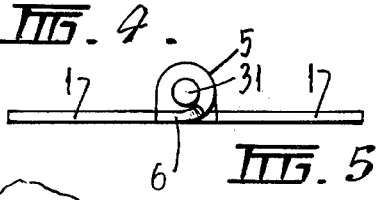
Figure 6:
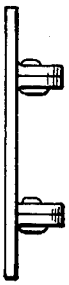

The hinge shown in FIGS. 4–6 is similar to that of FIGS. 2 and 3 and like numerals denote like parts. However, in lieu of the pin 3 there are used two shorter pins or rivets 31.

Figure 7:
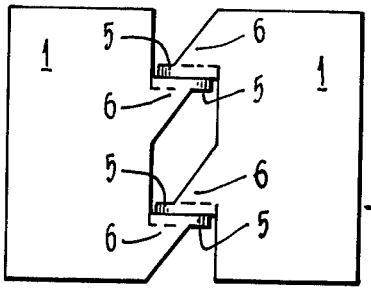
FIGS. 7, 8 and 9 are respectively plan, end and side views of another hinge in accordance with this invention.
Figure 8:
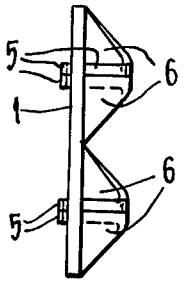
Figure 9:
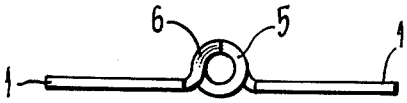

The hinge of FIGS. 7–9 is similar to that of FIGS. 4–6 and like numerals denote like parts excepting that the webs 6 lie at angles to the planes of the leaves 1 so that the hinge will be closable to have the leaves 1 closely adjacent.

Figure 1:
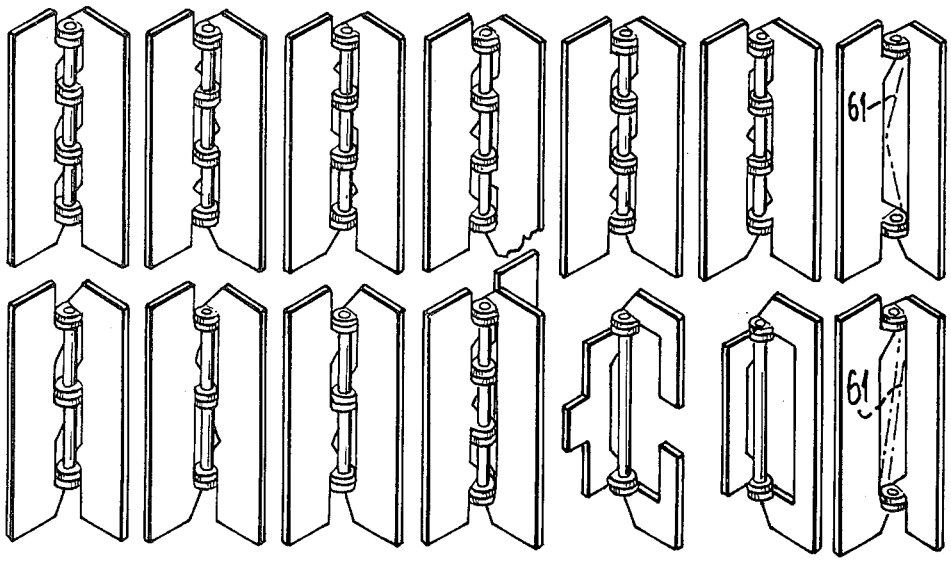
FIG. 1 is a perspective view of a number of hinges in accordance with this invention.

The hinges shown in FIG. 1 are only a few examples of the many variants possible on the hinges shown in FIGS. 2–9. It should be noted with respect to FIG. 1 that additional or enlarged strengthening webs which may be present are shown as dash-dot lines 61. In FIG. 1 one leaf in any one hinge may be the same as or different to the other leaf of that hinge similar as shown.

Hinges in accordance with this invention can be made in any convenient matter such as by extrusion, casting, moulding, fabrication, welding, forging or stamping. They may be made of any suitable material such as synthetic plastics material or metal. Extruded stock may be cut to the forms shown in the representations.

One particularly preferred manner of formation at least for the hinges shown in FIG. 6 is to form them by a process involving stamping a sheet of metal and bending the sheet of metal.

Figure 10:
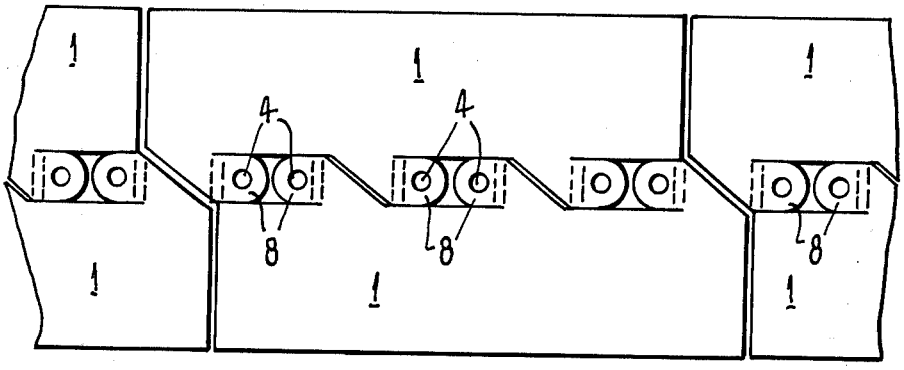
FIG. 10 is a plan view of a strip of metal used to make a hinge in accordance with this invention.

This last embodiment is illustrated in FIG. 10 which shows a sheet of metal which has been stamped to form six leaves 1 each with a projecting finger 8 having the holes 4 and which finger is subsequently or at least substantially simultaneously bent to form the tabs 5 (as shown by dash lines) and the webs.

It should be noted that there is little material wastage in such a stamping operation. Any number of tabs may be provided for each leaf.

Figure 11:
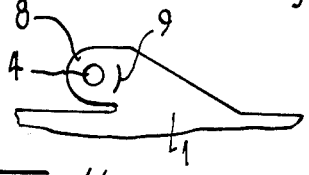
FIG. 11 is a fragmentary plan view of a strip of metal which has been stamped.
Figure 12:
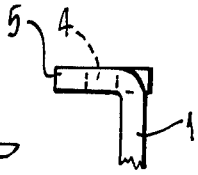
FIG. 12 is a fragmentary side view of the strip of FIG. 11 after a bending operation.

In a variant of the stamping process, shown in FIGS. 11 and 12, the fingers 8 are each formed with a slit 9 which will facilitate the bending operation. Further, it tends to reduce the likelihood of the holes 4 deforming out of round during the bending operation.

Figure 13:
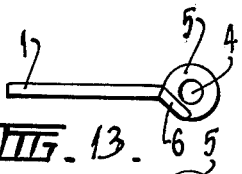
FIG. 13 is an end view of part of another hinge in accordance with this invention.

FIG. 13 shows part of an alternative hinge in which the web 6 lies at an angle to the leaf 1.

Figure 14:
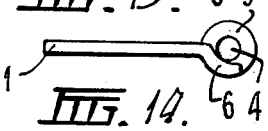
FIG. 14 is an end view of part of another hinge in accordance with this invention.

FIG. 14 shows part of an alternative hinge in which the web 6 is curved.

Figure 15:
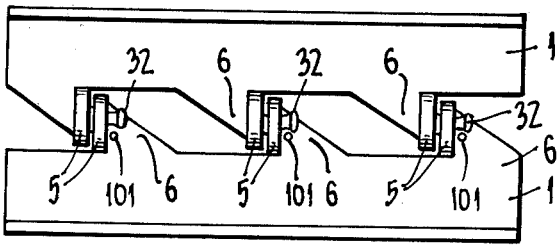
FIGS. 15 and 16 are respectively plan and end views (both in partly closed condition) of another hinge in accordance with this invention.
Figure 16:
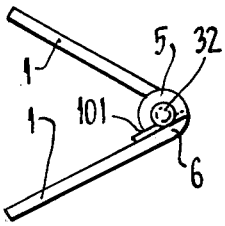

The hinge shown in FIGS. 15 and 16 is similar to those previously described excepting that a locking pin 101 engages with pins 32 to hinder disengagement of the leaves 1. The pins 32 may be integrally formed with respective ones of the tabs 5 such as by moulding, casting or stamping or may be separate integers. Alternatively, the pins 32 may be inserted in the holes 4 of the tabs 5 which support them. Only one pin 101 need be provided per hinge. In lieu of the pin 101 a C-shaped circlip may be used.

Figures 17, 18, 19, 20, 21, 22, 23, 24, 25, 26:
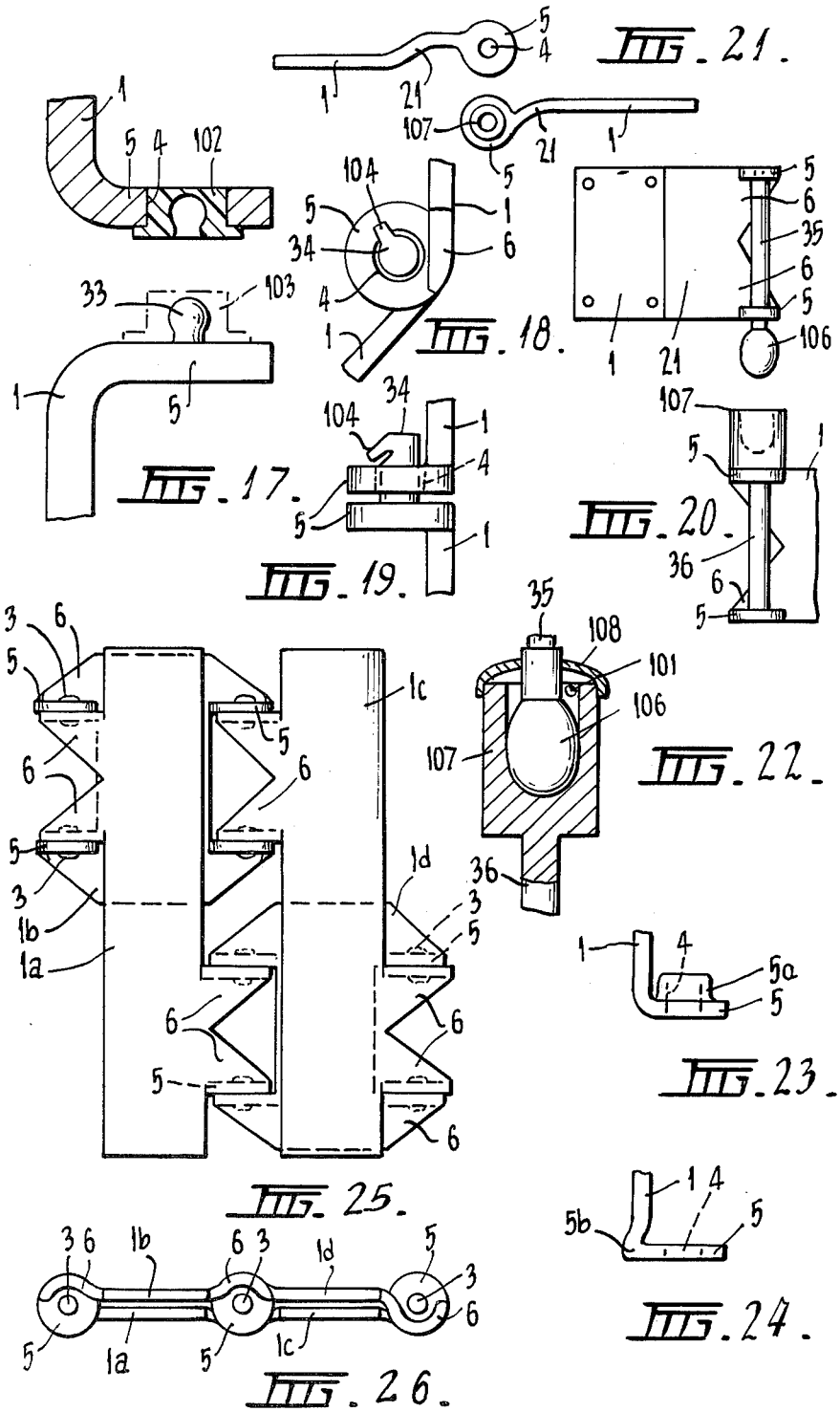
FIG. 17 is a fragmentary side view of another hinge in accordance with this invention.
FIGS. 18 and 19 are respectively fragmentary end and fragmentary side views of part of another hinge in accordance with this invention.
FIGS. 20, 21 and 22 are respectively a plan view (partly sectional), an end view (parts separated), a cross-sectional detail (parts assembled) of another hinge in accordance with this invention.
FIG. 23 is a fragmentary side view of part of another hinge in accordance with this invention.
FIG. 24 is a fragmentary side view of part of another hinge in accordance with this invention.
FIGS. 25 and 26 are side elevation and end views of a bi-fold hinge embodying this invention.

The hinge shown in FIG. 17 is similar to those previously described and like numerals denote like integers. However, in this instance one tab 5 carries a pin 33 as an inserted part or as an integral part thereof. The other tab has an integral part thereof or an insert 102 in the hole for receiving the pin 33. Alternatively, the pin 33 might be of such size as to be a close fit in the hole 4 without the need for the insert or the pin 33 may carry a bearing member 103 for being received into the hole 4. The insert 102 and bearing member 103 are preferably of synthetic plastics material.

The hinge shown in FIGS. 18 and 19 is similar to that of FIG. 17 and like numerals denote like parts. However, in this instance the insert 102 and member 103 are absent and in lieu a pin 34 carried by one of the tabs 5 is received in the hole 4 in the other of the tabs 5. The pin 34 has a deformable abutment 104 which can be deformed to allow release of the pin 34 from the hole 4 or which can move to a resiled condition to engage that one of the tabs 5 having the hole 4 to restrict against disassembly of the hinge.

The hinge shown in FIGS. 20, 21 and 22 is similar to those previously described and like numerals denote like parts. However, in this instance the leaves 1 include cranked portions 21. Further, a pin 35 is provided having an egg-shaped head 106 which is receivable in a socket 107 carried by a pin 36. If desired a locking pin 101 and dust-excluding cap 108 may be utilized. The holes shown in the leaves 1 are normally used for screws to mount the hinge; those holes may be countersunk on one or both sides of each leaf.

The hinge shown in FIG. 23 is similar to those previously described and like numerals denote like parts. However, the tab 5 is thickened at 5*a* as compared to the thickness of the leaf 1. The material for that thickening is conveniently provided out of material which would otherwise be wasted in a stamping operation to form the hinge. In this respect, the otherwise wasted material, at least some of which may come from hole 4, can be forged, swaged, extruded, formed or otherwise displaced to the correct location for the thickening either before or after a bending of the tabs.

As it is usually desirable for the planes of the leaves 1 to be generally tangential to the holes 4 the hinges, if formed by bending, must have the tabs 5 bent closely adjacent to the holes 4 if those holes have been previously formed. This may cause distortion of the shape of the holes 4. To reduce the likelihood of such distortion the tab may be bent as at 5*b* in FIG. 24 so that the hole 4 is away from the bending line but nevertheless remains substantially tangential to the plane of the leaf. The shape of FIG. 24 may be applied also to hinges moulded in synthetic plastics material.

FIGS. 25 and 26 are side elevation and end views of a bi-fold hinge embodying this invention. In this instance there are tabs 5, webs 6, pivot pins 3 and leaves 1*a*, 1*b*, 1*c* and 1*d*.

Advantages which can accrue from the use of this invention may include manufacturing savings in hinge formation, avoidance of the need to curl metal, strength without substantial weight, easy installation and maintenance, reduced friction as compared to some curl and other hinges and material saving. Still further, a very large variety of hinges may be made in accordance with this invention. Examples of such hinges include T-hinges, strap hinges, parliament hinges, concealed hinges, cranked hinges such as for cabinets, shutter hinges and hinges for automobile doors, boots and hoods. Simple deviations give other further manufacture and products.

Still further, the use of spaced apart tabs can easily provide room for insertion of a spring for the purpose of opening or closing the hinge. An illustration of this is that a helical torsion spring could be easily mounted on the hinge pin of the hinge on the extreme right in the bottom row of FIG. 1. That spring could bear at one end on one leaf and, at the other end, on the other leaf.

This provision of room between tabs also makes it particularly easy to construct a hinge having more than two leaves.

Washers or bushings may be interposed between the pin 3 or equivalent and the tabs 5 and may be located in the holes 4. Such washers or bushes may reduce friction or be used to lubricate.

It should be noted that the webs 6 can be used to limit the amount that the hinge will open and in this respect the edges of the webs may be angled with respect to the leaves and be so positioned relative to one another to limit opening of the hinge to a desired amount.

The leaves themselves may be cranked or be shaped or dimensioned to suit a particular use and may have strengthening ribs or gussets.

Modifications and adaptations may be made to the above described without departing from the spirit and scope of this invention which includes every novel feature and combination of features disclosed herein.

The claims form part of the disclosure of this specification.

I claim:

1. A hinge comprising:

a pair of leaves formed of sheet-like material, each of said leaves having at least a pair of triangularly shaped webs extending from a longitudinal side thereof and having terminal ends formed to provide sheet-like tabs oriented generally normal to the leaf, said pair of leaves being juxtapositioned so as to be rotatable about a common axis and so that said tabs are contiguous, with at least one of the tabs of one leaf supporting at least one of the tabs of the other leaf; and pivot means located at said common axis for coupling said contiguous tabs together for permitting said leaves to rotate with respect to each other.

2. A hinge as claimed in claim 1 wherein each of said webs lies generally in the same plane as the leaf.

3. A hinge according to claim 1 wherein said pivot means coupling said tabs is adjacent the junction of the webs and their associated tabs.

4. A hinge as claimed in claim 3 wherein said tabs have holes for receiving a hinge pin.

5. A hinge as claimed in claim 4 wherein said hole in said tab and the respective web are substantially tangential to each other.

* * * * *